US007052550B2

(12) United States Patent
Kamata et al.

(10) Patent No.: US 7,052,550 B2
(45) Date of Patent: May 30, 2006

(54) APPARATUS AND METHOD FOR COLORING ELECTRIC WIRE

(75) Inventors: Takeshi Kamata, Shizuoka (JP); Keigo Sugimura, Shizuoka (JP); Sei Saito, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/825,220

(22) Filed: Apr. 16, 2004

(65) Prior Publication Data

US 2005/0003077 A1 Jan. 6, 2005

(30) Foreign Application Priority Data

Apr. 17, 2003 (JP) ..... 2003-112566

(51) Int. Cl.
*B05B 7/06* (2006.01)
*B05C 5/00* (2006.01)

(52) U.S. Cl. ..... 118/314; 118/325

(58) Field of Classification Search ..... 118/113, 118/114, 115, 325; 427/117, 424
See application file for complete search history.

(56) References Cited

U.S. PATENT DOCUMENTS 2,726,631 A 12/1955 Rutherford, Jr.
4,877,645 A * 10/1989 Bleich et al. ..... 427/117

FOREIGN PATENT DOCUMENTS

| | | |
|---|---|---|
| GB | 1 229 009 A | 4/1971 |
| GB | 1 423 324 A | 2/1976 |
| JP | 5-111947 | 5/1993 |
| JP | 6-119833 | 4/1994 |
| JP | 9-92056 | 4/1997 |
| JP | 2001-256721 | 9/2001 |
| JP | 2002-233729 | 8/2002 |

* cited by examiner

*Primary Examiner*—Chris Fiorilla
*Assistant Examiner*—Yewebdar Tadesse
(74) *Attorney, Agent, or Firm*—Armstrong, Kratz, Quintos, Hanson & Brooks, LLP

(57) ABSTRACT

The apparatus for coloring a wire includes a plurality of coloring nozzles, each of which spouts a liquid coloring agent toward an outer surface of a wire with a specific amount thereof per spouting so as to allow the liquid drop of the coloring agent to adhere to the outer surface of the wire, thereby coloring the wire. The coloring agent adheres on the outer surface of the wire so as to form a spot. Each coloring nozzle includes an insert member for receiving the coloring agent therein and a nozzle member that communicates with the insert member. The length of the nozzle member is different from each other. The apparatus selects one coloring nozzle from a plurality of the coloring nozzles in response to the size of the spot to be formed on the outer surface of the wire and spouts the coloring agent.

3 Claims, 8 Drawing Sheets

APPARATUS AND METHOD FOR COLORING ELECTRIC WIRE

BACKGROUND OF THE INVENTION (1) Field of the Invention

The present invention relates to an apparatus and method for coloring an electric wire that includes an electrically conductive core wire and an electrically insulating coating for coating the core wire.

(2) Description of the Related Art

Various electronic devices are mounted on a motor vehicle as a mobile unit. Therefore, the motor vehicle is provided with a wiring harness for transmitting power from a power source and control signals from a computer to the electronic devices. The wiring harness includes a plurality of electric wires and connectors attached to an end of the wires.

The wire includes an electrically conductive core wire and a coating made of insulating synthetic resin, which coats the core wire. The wire is a so-called coated wire. A connector includes a terminal fitting and a connector housing that receives the terminal fitting therein. The terminal fitting, consisting of electrically conductive sheet metal or the like, is attached to an end of the wire and electrically connected to the core wire of the wire. The connector housing made of electrically insulating synthetic resin is formed in a box-shape. When the connector housing is connected to the electronic devices, each wires is connected to the corresponding electronic device through the terminal fitting, thereby the wiring harness transmits the desired electric power and signals to the electronic devices.

When the wiring harness is assembled, first the wire is cut into a specific length and then the terminal fitting is attached to an end of the wire after removing the coating near the end. A wire is connected to another wire according to the need. Afterward, the terminal fitting is inserted into the connector housing, thereby assembling the wiring harness.

The wire of the wiring harness must be distinguished in terms of the size of the core wire, the material of the coating (concerning with alteration in the materials depending upon heat-resisting property), and a purpose of use. The purpose of use means, for example, an air bag, antilock brake system (ABS), control signal such as speed data, and system in a motor vehicle in which the wire is used, such as a power transmission system.

The coating of the wire used in the wiring harness has been colored to a desired color by mixing a coloring agent of the desired color with synthetic resin which constitutes the coating when the synthetic resin of the coating is applied onto the circumference of the core wire by extrusion (for example, see Japanese Patent Application Laid-Open No. H5-111947, Japanese Patent Application Laid-Open No. H6-119833, and Japanese Patent Application Laid-Open No. H9-92056). In this case, when a color of an outer surface of the wire is altered, it is necessary to halt an operation of an extrusion apparatus that performs the extrusion-coating. That is, whenever the color of the wire is changed, it is necessary to halt an operation of an extrusion apparatus, causing increasing in a time period and labor hour required for the production of the wire and deteriorating in the productivity of the wire.

Alternatively, the coloring agent to be mixed has been replaced while the extrusion apparatus is performing the extrusion-coating. In such a case, right after changing the color of the coloring agent, a wire, in the color of the synthetic resin of which a coloring agent before the replacement and a coloring agent after the replacement are mixed, has been inevitably manufactured, causing the deterioration in the yield of the material of the wire.

In order to prevent the deterioration in the productivity of the wire and in the yield of the material of the wire, the present applicant proposed a method, in which monochromatic wire is produced, then the outer surface of the wire is colored with a desired color according to the need, thereby assembling a wiring harness (see Japanese Patent Application No. 2001-256721). Alternatively, the present applicant proposed an apparatus for coloring a wire, by which upon coloring a monochromatic wire, a liquid coloring agent is spouted toward the outer surface of the wire with a specific amount thereof per spouting so as to allow the liquid drop of the coloring agent to adhere to the outer surface of the wire, thereby coloring the wire with the desired color (see Japanese Patent Application No. 2002-233729).

The coloring apparatus described above includes a coloring nozzle that spouts the liquid coloring agent toward the outer surface of the wire with a specific amount thereof per spouting. The coloring nozzle includes a receiver for receiving the coloring agent under pressure, a cylindrical nozzle member that communicates with the receiver and guides the coloring agent therethrough, and a valve element provided in the receiver, which can approach and leave a base end of the coloring nozzle.

In the coloring apparatus for coloring the wire, the coloring agent is spouted from an end of the nozzle member toward the outer surface of the wire in a state that the valve element leaves away from the nozzle member. Further, in the coloring apparatus for coloring the wire, the valve element approaches the nozzle member so as to come in contact with the nozzle member, thereby halting the spouting of the coloring agent from an end of the nozzle member toward the outer surface of the wire.

As for the coloring apparatus, in which the coloring agent is spouted toward the outer surface of the wire with a specific amount thereof per spouting, when the amount of the liquid drop of the coloring agent is changed, that is, when the area to be colored of the outer surface of the wire is changed, the pressure in the receiver as described above may be changed, or alternatively, the time period when the valve element leaves the base end of the nozzle member may be changed. However, in order to change such a pressure or such a time period, the coloring apparatus is forced to have a complicated mechanism therein, thereby causing an increasing in the cost of the coloring apparatus.

SUMMARY OF THE INVENTION

Therefore, the objective of the present invention is to provide an apparatus having a simple structure and a simple method for coloring the outer surface of the wire, by which the area to be colored of the outer surface of the wire can be easily changed.

In order to solve the above problems and to attain the above objective, the present invention is to provide an apparatus for coloring an electric wire comprising:

a plurality of coloring nozzles, each of which spouts a liquid coloring agent toward an outer surface of an electric wire with a specific amount thereof per spouting so as to allow a liquid drop of the coloring agent to adhere to the outer surface of the electric wire, thereby coloring the electric wire, wherein each coloring nozzle includes a receiver for receiving the coloring agent therein and a nozzle member that communicates with the receiver and allows the coloring agent to pass therethrough, wherein lengths of the respective nozzle members of a plurality of the coloring nozzles are different from one another, wherein the coloring nozzle is changed in response to an amount of the liquid drop of the coloring agent.

With the construction described above, the amount of the liquid drop of the coloring agent spouted from the long nozzle member is smaller than that spouted from the short nozzle member.

In this specification, the coloring agent means a liquid substance, in which a coloring material (organic substance for use in industry) is dissolved and dispersed in water or other solvent. The organic substance described above is a dye or a pigment (most of them being organic substances and synthetic substances). Sometimes, a dye is used as a pigment and a pigment is used as a dye. As an example, the coloring agent may be a coloring liquid or coating material. The coloring liquid is a liquid, in which a dye is dissolved or dispersed in a solvent. The coating material is a material, in which a pigment is dispersed in a liquid dispersion. When the outer surface of the coating is colored with a coloring liquid, the dye permeates into the coating. When the outer surface of the coating is colored with a coating material, the pigment adheres to the outer surface without permeating into the coating. In the specification, "to color the outer surface of the coating" means to dye a part of the outer surface of the coating of the wire with a dye or to coat a part of the outer surface of the coating of the wire with a pigment.

Preferably, the solvent and liquid dispersion have an affinity to the synthetic resin that constitutes the coating in order to securely permeate the dye into the coating or to allow the pigment to securely adhere to the outer surface of the coating.

In this specification, "spouting" means that the liquid coloring agent in a state of the liquid drop is ejected vigorously from the coloring nozzle toward the outer surface of the wire.

According to the present invention, the amount of the liquid drop of the coloring agent is increased or decreased depending on the pressure loss occurred when the coloring agent flows in the nozzle member. Therefore, the amount of the liquid drop of the coloring agent can be increased or decreased by selecting an appropriate coloring nozzle from a plurality of the coloring nozzles, which include the respective nozzle members having different length from one another, so as to spout the coloring agent. That is, by selecting an appropriate coloring nozzle, the area of a portion where the coloring agent adhere to, i.e. the area to be colored can be varied. Accordingly, the area to be colored can be easily varied with a simple construction in which a plurality of the coloring nozzles including the respective nozzle members having different lengths from one another are provided.

Preferably, the electric wire is stretched in the longitudinal direction of the electric wire and a plurality of the coloring nozzles are arranged in the longitudinal direction of the electric wire.

With the construction described above, the wire is stretched in the longitudinal direction of the wire and the coloring nozzles are arranged in the longitudinal direction of the wire, thereby allowing the coloring agents spouted from all of the coloring nozzles to securely adhere to the outer surface of the wire. Since the coloring agents spouted from all of the coloring nozzles are allowed to securely adhere to the outer surface of the wire, the area to be colored can be securely varied by changing the coloring nozzle.

In order to solve the problems and to attain the objective, the present invention is to provide a method of coloring an electric wire by using an apparatus for coloring an electric wire comprising:

a plurality of coloring nozzles, each of which spouts a liquid coloring agent toward an outer surface of an electric wire with a specific amount thereof per spouting so as to allow a liquid drop of the coloring agent to adhere to the outer surface of the electric wire, thereby coloring the electric wire, wherein each coloring nozzle includes a receiver for receiving the coloring agent therein and a nozzle member that communicates with the receiver and allows the coloring agent to pass therethrough, wherein lengths of the respective nozzle members of a plurality of the coloring nozzles are different from one another, wherein the coloring nozzle is changed in response to an amount of the liquid drop of the coloring agent, thereby coloring the outer surface of the electric wire.

With the construction described above, the amount of the liquid drop of the coloring agent spouted from the long nozzle member is smaller than that spouted from the short nozzle member. The amount of the liquid drop of the coloring agent is increased or decreased depending on the pressure loss occurred when the coloring agent flows in the nozzle member. Therefore, the amount of the liquid drop of the coloring agent can be increased or decreased by selecting an appropriate coloring nozzle from a plurality of the coloring nozzles, which include the respective nozzle members having different length from one another, so as to spout the coloring agent. That is, by selecting an appropriate coloring nozzle, the area of a portion where the coloring agent adhere to, i.e. the area to be colored can be varied. Accordingly, the area to be colored can be easily varied by a simple method, in which the coloring agent is spouted from the appropriate coloring nozzle selected from a plurality of the coloring nozzles including the respective nozzle members having different lengths from one another.

In order to solve the problems and to attain the objective, the present invention is to provide an apparatus for coloring an electric wire comprising:

a coloring nozzle, which spouts a liquid coloring agent toward an outer surface of an electric wire with a specific amount thereof per spouting so as to allow a liquid drop of the coloring agent to adhere to the outer surface of the electric wire, thereby coloring the electric wire, wherein the coloring nozzle includes a receiver for receiving the coloring agent therein and a first nozzle member that communicates with the receiver and allows the coloring agent to pass therethrough, wherein a plurality of second nozzle members, lengths of which are different from one another, are provided, each second nozzle member being detachably attached to an end of the first nozzle member, wherein the second nozzle member to be attached to the first nozzle member is changed in response to an amount of the liquid drop of the coloring agent.

With the construction described above, the amount of the liquid drop of the coloring agent spouted when the long second nozzle member is attached to the first nozzle member is smaller than that spouted when the short second nozzle member is attached to the first nozzle member. The amount of the liquid drop of the coloring agent is increased or decreased depending on the pressure loss occurred when the coloring agent flows in the second nozzle member and in the first nozzle member. Therefore, the amount of the liquid drop of the coloring agent can be increased or decreased by selecting an appropriate second nozzle member from a plurality of the second nozzle members having different length from one another so as to attach the selected second nozzle member to the first nozzle member. That is, by selecting an appropriate second nozzle member, the area of a portion where the coloring agent adhere to, i.e. the area to be colored can be varied. Accordingly, the area to be colored can be easily varied with a simple construction in which an appropriate second nozzle member is selected from a plurality of the second nozzle members having different length from one another so as to attach the selected second nozzle member to the first nozzle member.

In order to solve the problems and to attain the objective, the present invention is to provide a method of coloring an electric wire by using an apparatus for coloring an electric wire comprising:

a coloring nozzle, which spouts a liquid coloring agent toward an outer surface of an electric wire with a specific amount thereof per spouting so as to allow a liquid drop of the coloring agent to adhere to the outer surface of the electric wire, thereby coloring the electric wire, wherein the coloring nozzle includes a receiver for receiving the coloring agent therein and a first nozzle member that communicates with the receiver and allows the coloring agent to pass therethrough, wherein a plurality of second nozzle members, lengths of which are different from one another, are provided, each second nozzle member being detachably attached to an end of the first nozzle member, wherein the second nozzle member to be attached to the first nozzle member is changed in response to an amount of the liquid drop of the coloring agent, thereby coloring the outer surface of the electric wire.

With the construction described above, the amount of the liquid drop of the coloring agent spouted when the long second nozzle member is attached to the first nozzle member is smaller than that spouted when the short second nozzle member is attached to the first nozzle member. The amount of the liquid drop of the coloring agent is increased or decreased depending on the pressure loss occurred when the coloring agent flows in the second nozzle member and in the first nozzle member. Therefore, the amount of the liquid drop of the coloring agent can be increased or decreased by selecting an appropriate second nozzle member from a plurality of the second nozzle members having different length from one another so as to attach the selected second nozzle member to the first nozzle member. That is, by selecting an appropriate second nozzle member, the area of a portion where the coloring agent adhere to, i.e. the area to be colored can be varied. Accordingly, the area to be colored can be easily varied by a simple method, in which an appropriate second nozzle member is selected from a plurality of the second nozzle members having different length from one another so as to attach the selected second nozzle member to the first nozzle member.

DESCRIPTION OF THE PREFERRED EMBODIMENTS

Figure 1:
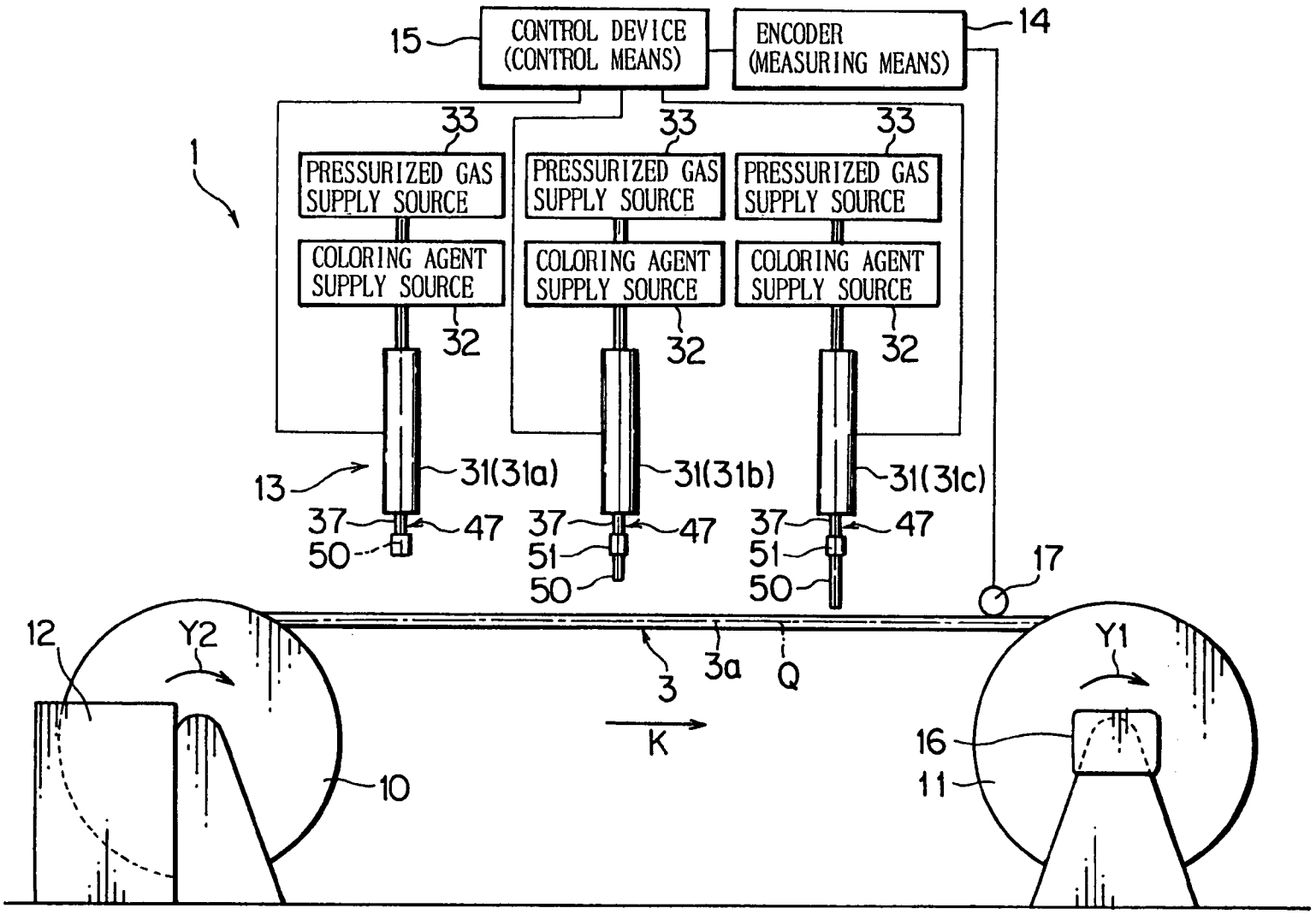
FIG. 1 is an illustration of a structure of an apparatus for coloring a wire according to the first preferred embodiment of the present invention.

In the following, an apparatus 1 for coloring an electric wire (i.e. coloring apparatus 1) according to a first preferred embodiment of the present invention will be explained with reference to. FIGS. 1–6. The coloring apparatus 1 shown in FIG. 1 and so on is an apparatus for forming a mark 6 on a part of an outer surface 3*a* of an electric wire 3 (i.e. wire 3). That is, the coloring apparatus 1 colors the outer surface 3*a* of the wire 3, i.e. performs marking on the outer surface 3*a* of the wire 3.

Figure 6A:
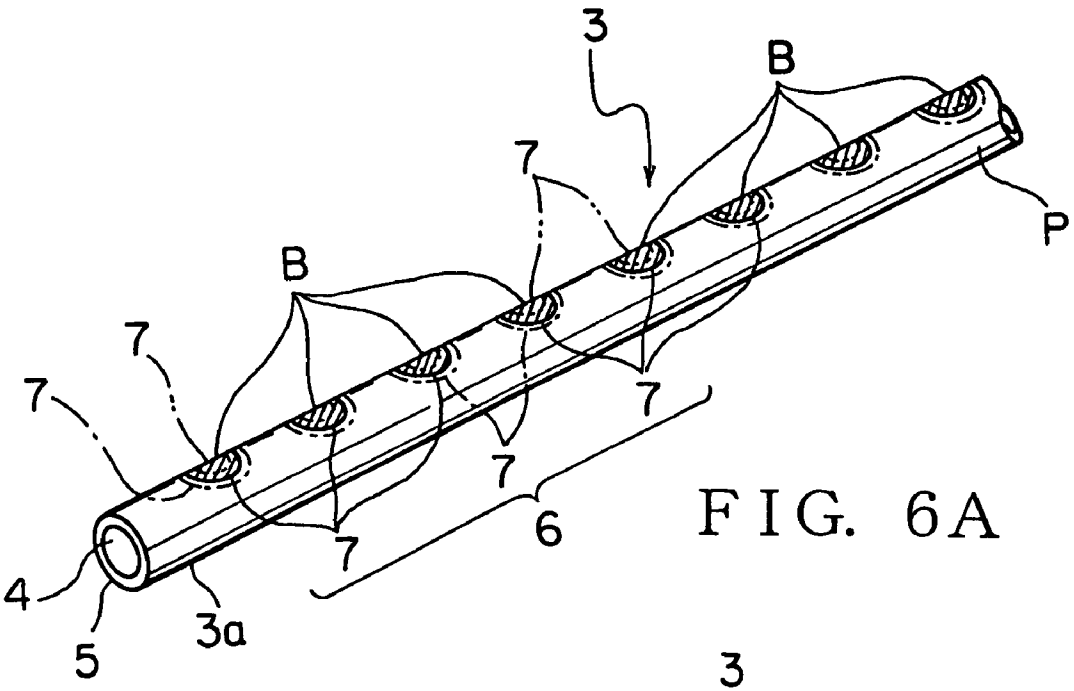
FIG. 6A is a perspective view illustrating a wire colored by the coloring apparatus shown in FIG. 1.

An electric wire 3 constitutes a wiring harness to be mounted on a motor vehicle or the like as a mobile unit. As shown in FIG. 6A and so on, the wire 3 includes an electrically conductive core wire 4 and an electrically insulating coating 5. A plurality of element wires are bundled up to form the core wire 4. Each element wire of the core wire 4 is made of electrically conductive metal. The core wire 4 may be constituted by a single element wire. The coating 5 is made of synthetic resin such as polyvinyl chloride (PVC). The coating 5 coats the core wire 4. Therefore, the outer surface 3*a* of the wire 3 means an outer surface of the coating 5.

The coating 5 has a monochrome color P. A desired coloring agent may be mixed with the synthetic resin of the coating 5 so as to make the color of the outer surface 3*a* of the wire 3 be a monochrome color P, or alternatively, the monochrome color P may be set as the color of the synthetic resin itself without adding a coloring agent to the synthetic resin of the coating 5. In the latter case, the outer surface 3*a* of the wire 3 is not colored, i.e. the coating 5 is not colored.

Figure 6B:
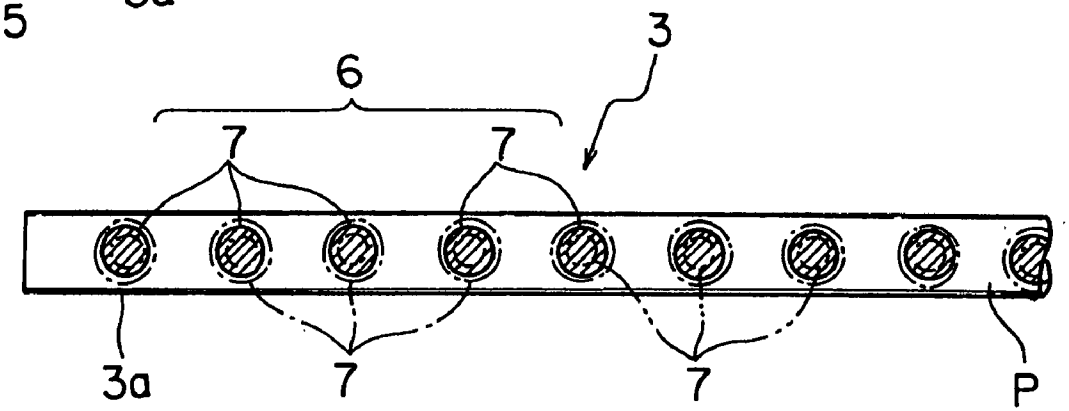
FIG. 6B is a plan view illustrating the wire shown in FIG. 6A.

On the outer surface 3*a* of the wire 3, there are formed a mark 6 consisting of a plurality of spots 7. The spot 7 has a color B (indicated with parallel oblique lines in FIGS. 6A and 6B), which is different from the monochrome color P. The spot 7 is round in the plan view as shown in FIG. 6B. A plurality of the spots 7 are arranged in the longitudinal direction of the wire 3 according to a predetermined pattern. The distance between the centers of the spots 7 situated adjacently to each other is predetermined.

The spot 7 shown with a solid line in FIGS. 6A and 6B is formed when the coloring agent is spouted from the second coloring nozzle 31*b* as explained later on. When the coloring agent is spouted from the first coloring nozzle 31*a* as explained later on, as shown with an alternate long and short dash line in FIGS. 6A and 6B, the spot 7 becomes large compared to the spot 7 shown with a solid line. Further, When the coloring agent is spouted from the third coloring nozzle 31*c* as explained later on, as shown with an alternate long and two short dashes line in FIGS. 6A and 6B, the spot 7 becomes small compared to the spot 7 shown with a solid line.

A plurality of the wires 3 are bundled and connectors are attached to respective ends of the wires 3, thereby constructing a wiring harness. The connectors are coupled with respective mating connectors of various electronic instruments in a motor vehicle and so on, thereby the wiring harness (i.e. the wires 3) transmits various signals and electric power to the electronic instruments.

The wires 3 are distinguishable from one another by changing a color B of each spot 7 of the mark 6. In the figure, as an example, the color B of all of the spots 7 is set the same, however, the color B may be changed for the respective spots 7 according to the need. The color B is used to distinguish types of the wires in a wiring harness or systems. That is, the color B is used to distinguish the types of the wires in the wiring harness or the purposes of use.

As shown in FIG. 1, the coloring apparatus 1 includes a feed reel 10 as feed means, winding reel 11 as winding means, brake 12 as stretch means, coloring unit 13, encoder 14 as measuring means, and control device 15 as control means. The feed reel 10 and winding reel 11 are placed rotatably on a floor or the like in a plant. The feed reel 10 and winding reel 11 are arranged having a distance therebetween.

The feed reel 10 winds up the wire 3 and forwards the wire 3 toward the winding reel 11. The winding reel 11 receives the wire 3 forwarded from the feed reel 10. The winding reel 11 is provided with a motor 16 or the like and rotates along an arrow Y1 shown in FIG. 1 with a drive force by the motor 16.

The feed reel 10 is not provided with a motor and is rotated along an arrow Y2 shown in FIG. 1 by being pulled by the wire 3 when the winding reel 11 rotates along the arrow Y1 shown in FIG. 1 so as to wind up the wire 3. The direction of the arrow Y1 is the same as that of the arrow Y2.

When the motor 16 rotates and drives the winding reel 11 to rotate along the arrow Y1, the wire 3 is forwarded in the longitudinal direction of the wire 3, that is, in the direction of the axis Q of the wire 3, i.e. in the direction of an arrow K shown in FIG. 1. The arrow K indicates one direction.

The brake 12 is fixed to both the feed reel 10 and the floor. The brake 12 causes friction between the brake 12 and the feed reel 10. When the feed reel 10 is rotated, the brake 12 gives a frictional force to the feed reel 10 so as to restrict the rotation of the feed reel 10. That is, the brake 10 tends to make the number of revolutions of the feed reel 10 be smaller than that of the winding reel 11.

That is, the brake 12 gives a tension to the wire 3, which is stretched between the feed reel 10 and the winding reel 11, along the longitudinal direction of the wire 3. That is, the brake 12 stretches the wire 3 giving the tension to the wire 3 along the longitudinal direction of the wire 3.

As shown in FIG. 1, the coloring unit 13 is arranged between the feed reel 10 and the winding reel 11. The coloring unit 13 includes a plurality of coloring nozzles 31, a plurality of coloring agent supply sources 32, and a plurality of pressurized gas supply sources 33.

The coloring nozzle 31 spouts the liquid coloring agent fed from the coloring agent supply sources 32 toward the outer surface 3*a* of the wire 3 with a specific amount of the coloring agent per spouting. The coloring nozzle 31 allows the spouted liquid drop or drops to adhere to outer surface 3*a* of the wire 3 so as to color (or mark) at least a part of the outer surface 3*a* of the wire 3.

In the figure, as an example, three coloring nozzles 31 are provided. These coloring nozzles 31 are arranged having a distance between one another along the longitudinal direction of the wire 3, which is stretched by the brake 12 or the like. The three coloring nozzles 31 are separately abbreviated as 31*a* for the first coloring nozzle, 31*b* for the second coloring nozzle, and 31*c* for the third coloring nozzle in turn from the upstream to the downstream along the arrow K shown in FIG. 1.

Figure 2:
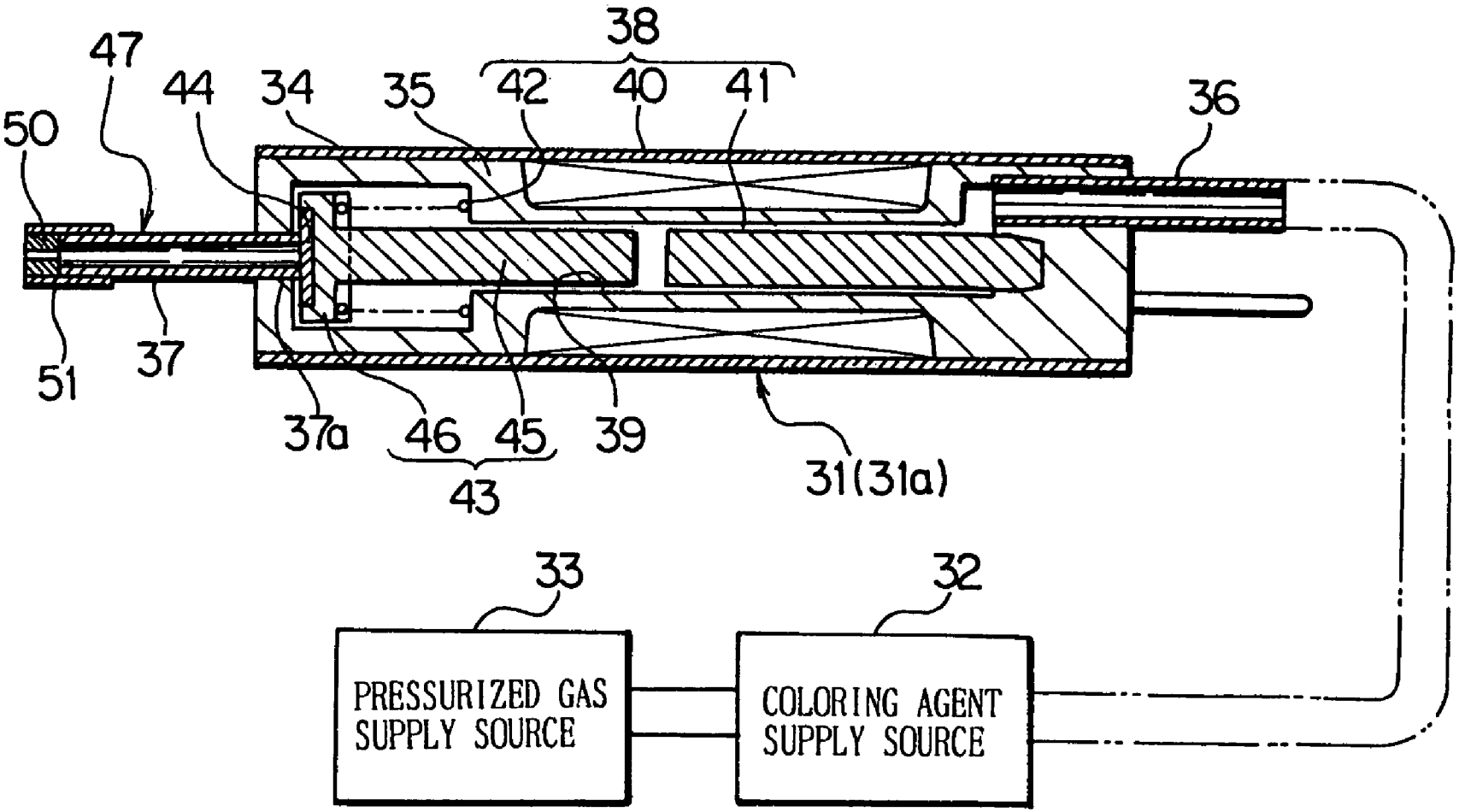
FIG. 2 is a cross sectional view illustrating a structure of the first coloring nozzle of a coloring unit in the coloring apparatus shown in FIG. 1.

Since the structures of the respective first to third coloring nozzles 31*a*, 31*b* and 31*c* are practically the same, only the first coloring nozzle 31*a* will be explained in the following. As shown in FIG. 2, the first coloring nozzle 31*a* includes a cylindrical nozzle body 34, insert member 35 received in the nozzle body 34, inlet pipe 36, first nozzle member 37, valve mechanism 38, second nozzle member 50, and connection pipe 51.

The insert member 35 is formed in a cylindrical shape and provided with a channel 39 to let the coloring agent pass therethrough. That is, the channel 39 is filled with the coloring agent supplied from the coloring agent supply source 32. The insert member 35 is the receiver for receiving the liquid coloring agent. The inlet pipe 36 communicates with the channel 39 to guide the coloring agent supplied from the coloring agent supply source 32 into the channel 39.

The first nozzle member 37 is formed in a cylindrical shape and communicates with the channel 39 so as to guide the coloring agent in the channel 39 to the outside of the first coloring nozzle 31*a*. The inner diameter of the first nozzle member 37 is smaller than the inner diameter of the insert member 35, i.e. the outer diameter of the channel 39. The first nozzle member 37 is aligned with the nozzle body 34. The first nozzle member 37 is made of stainless steel.

The valve mechanism 38 includes a coil 40, valve body 41, and coil spring 42. The coil 40 is provided outside the channel 39 and embedded in the insert member 35. A current is applied to the coil 40 from the outside. The valve body 41 is received in the insert member 35 and includes an electrically conductive body part 43 and valve element 44. The body part 43 integrally includes a cylindrical cylinder part 45 and disc-shaped disc part 46 which continues to an end of the cylinder part 45.

The disc part 46 of the body part 43 faces a base end 37*a* of the first nozzle member 37. The body part 43 is received in the channel 39 in a state that the longitudinal direction of the cylinder part 45 is parallel to that of the nozzle body 34. The base end 37*a* is the base end of the nozzle member. The body part 43 (or the valve body 41) is provided movably in the longitudinal direction of the cylinder part 45, i.e. the longitudinal direction of the nozzle body 34.

The valve element 44 is attached to the disc part 46 of the body part 43. That is, the valve element 44 is received in the insert member 35. The valve element 44 faces the base end 37*a* of the first nozzle member 37. The valve element 44 approaches or leaves the base end 37*a* of the first nozzle member 37.

When the valve element 44 comes in contact with the base end 37*a* of the first nozzle member 37, the coloring agent in the channel 39 is prevented from entering into the first nozzle member 37, that is, the watertight condition between the valve element 44 and the base end 37*a* is attained. When the valve element 44 leaves the base end 37*a* of the first nozzle member 37, the coloring agent is allowed to pass through the first nozzle member 37 and the second nozzle member 50 so as to be spouted toward the outer surface 3*a* of the wire 3.

Thus, the valve element 44 approaches or leaves the base end 37*a* between the opening position shown with an alternate long and two short dashes line in FIG. 2 and the closing position shown with a solid line in FIG. 2. At the opening position, the valve element 44 leaves the base end 37*a*, so that the coloring agent is allowed to pass through the first nozzle member 37 and the second nozzle member 50 so as to be spouted toward the outer surface 3*a* of the wire 3. At the closing position, the valve element 44 comes in contact with the base end 37*a*, so that the coloring agent is not allowed to pass through the first nozzle member 37 and the second nozzle member 50 to be spouted toward the outer surface 3*a* of the wire 3.

The coil spring 42 energizes the disc part 46 in such a direction that the valve element 44 approaches the base end 37*a* of the first nozzle member 37.

The second nozzle member 50 is formed in a cylindrical shape. The second nozzle member 50 is made of polyetheretherketone (PEEK). The outer diameter of the second nozzle member 50 is equal to that of the first nozzle member 37.

Figure 3:
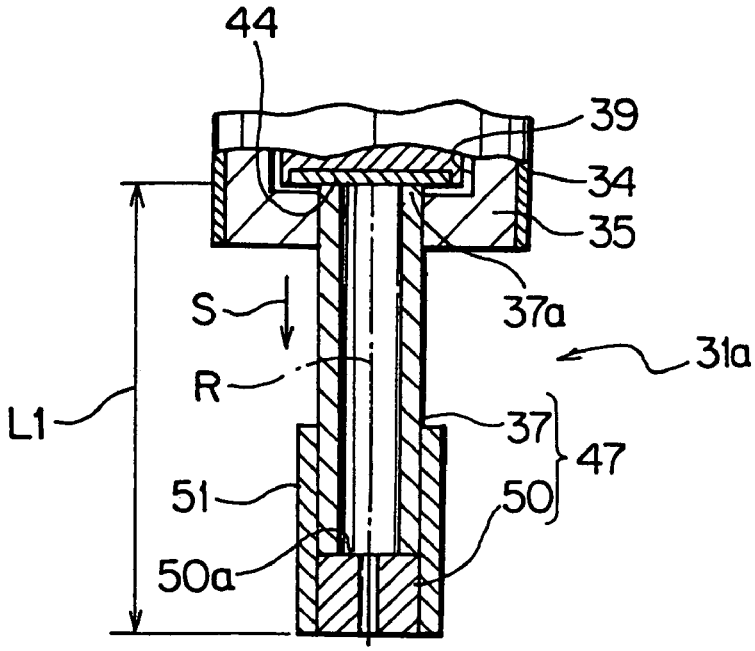
FIG. 3 is a cross sectional view illustrating an end part of the first coloring nozzle of the coloring unit in the coloring apparatus shown in FIG. 1.
Figure 4:
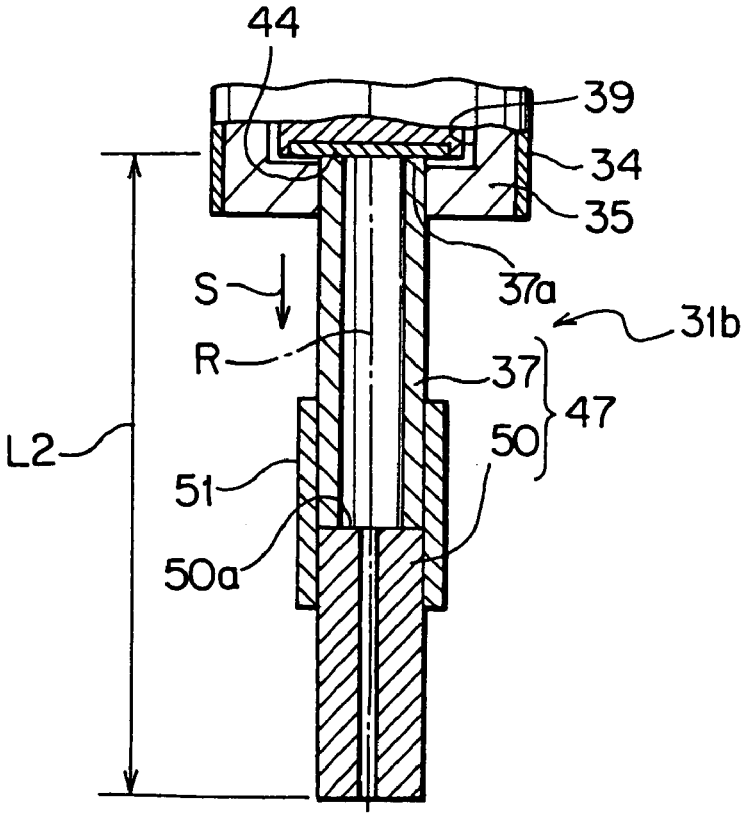
FIG. 4 is a cross sectional view illustrating an end part of the second coloring nozzle of the coloring unit in the coloring apparatus shown in FIG. 1.
Figure 5:
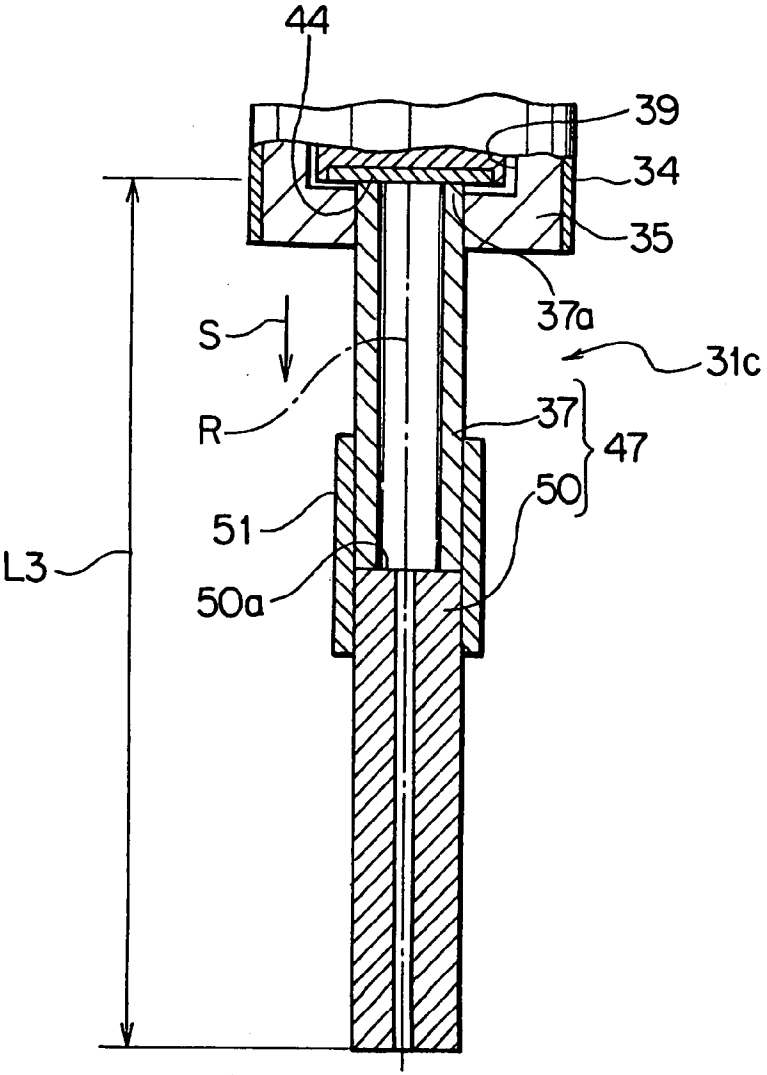
FIG. 5 is a cross sectional view illustrating an end part of the third coloring nozzle of the coloring unit in the coloring apparatus shown in FIG. 1.

As shown in FIGS. 3–5, the inner diameter of the second nozzle member 50 is smaller than that of the first nozzle member 37. The second nozzle member 50 is aligned with the first nozzle member 37 and connected to the first nozzle member 37.

The second nozzle member 50 is arranged nearer to the wire 3 than the first nozzle member 37 is arranged near the wire 3. A watertight condition is attained between the first nozzle member 37 and the second nozzle member 50. The coloring agent flows through the first nozzle member 37 and the second nozzle member 50 along an arrow S, i.e. in the longitudinal direction of the first nozzle member 37.

An end face 50*a* of the second nozzle member 50 projects from an inner face of the first nozzle member 37 toward the inside of the first nozzle member 37. The end face 50*a* is formed flat in a direction crossing the direction of the arrow S at right angles.

The first nozzle member 37 and the second nozzle member 50 constitute the nozzle member 47. The nozzle member 47 communicates with the insert member 35. The coloring agent flows through the nozzle member 47.

The connection pipe 51 is made of fluorine resin and formed in a cylindrical shape. The inner diameter of the connection pipe 51 is practically the same as the outer diameter of the first nozzle member 37 and the outer diameter the second nozzle member 50. The connection pipe 51 fits to both the outside of the first nozzle member 37 and the outside of the second nozzle member 50 so as to connect the first nozzle member 37 with the second nozzle member 50. The connection pipe 51 makes the second nozzle member 50 detachable from the first nozzle member 37.

The first coloring nozzle 31*a* allows the coloring agent supplied from the coloring agent supply source 32 to flow through the inlet pipe 36 and guides the coloring agent into the channel 39. On a condition that a current is not applied to the coil 40, the valve element 44 comes in contact with the base end 37*a* of the first nozzle member 37 due to the energizing force by the coil spring 42, thereby the coloring agent stays within the channel 39.

When a current is applied to the coil 40, the valve element 44 attached to the disc part 46 leaves the base end 37*a* of the first nozzle member 37 against the energizing force by the coil spring 42, thereby allowing the coloring agent to pass through the first nozzle member 37 and the second nozzle member 50 along the arrow S. Thereby, the coloring nozzle 31 spouts the coloring agent from the second nozzle member 50. The current is applied to the coil 40 for a predetermined period of time on the basis of a command from the control device 15. Therefore, the first coloring nozzle 31*a* spouts the coloring agent toward the outer surface 3*a* of the wire 3 with a specific amount of the coloring agent per spouting.

Each coloring nozzle 31*a*, 31*b* or 31*c* is held on a condition that the most upper part of the wire 3 is situated on an extension of the axis R (shown with an alternate long and short dash line in FIGS. 3–5) of the first nozzle member 37. Each coloring nozzle 31*a*, 31*b* or 31*c* spouts the coloring agent along the axis R. That is, each coloring nozzle 31*a*, 31*b* or 31*c* spouts the coloring agent toward the most upper part of the wire 3 with the specific amount of the coloring agent per spouting. Each coloring nozzle 31*a*, 31*b* or 31*c* is the coloring means.

The lengths of the second nozzle members 50 of the respective coloring nozzles 31*a*, 31*b* and 31*c* in the direction of the axis R are different from one another. That is, the total lengths consisting of the respective lengths of the second nozzle members 50 and the length of the first nozzle members 37 for the respective coloring nozzles 31*a*, 31*b* and 31*c* are different from one another. That is, the lengths L1, L2 and L3 (shown in FIGS. 3–5) of the respective nozzle members 47 are different from one another. In the figures, as an example, the length L1 (shown in FIG. 3) of the nozzle member 47 of the first coloring nozzle 31*a* is smaller than the length L2 (shown in FIG. 4) of the nozzle member 47 of the second coloring nozzle 31*b*, while the length L2 of the nozzle member 47 of the second coloring nozzle 31*b* is smaller than the length L3 (shown in FIG. 5) of the nozzle member 47 of the third coloring nozzle 31*c*.

When the coloring agent passes through the nozzle member 47, a pressure loss takes place in each coloring nozzle 31*a*, 31*b* or 31*c* due to the friction force and so on occurred between the coloring agent and the inner surface of the nozzle member 47. When the pressure loss takes place, the amount of the liquid drop of the coloring agent spouted from the nozzle member 47 is reduced.

Since the length L1 is smaller than the length L2 and the length L2 is smaller than the length L3, therefore the pressure loss in the first coloring nozzle 31*a* is smaller than that in the second coloring nozzle 31*b*, and the pressure loss in the second coloring nozzle 31*b* is smaller than that in the third coloring nozzle 31*c*. Consequently, the amount of the liquid drop of the coloring agent spouted from the first coloring nozzle 31*a* is larger than that spouted from the second coloring nozzle 31*b*, and the amount of the liquid drop of the coloring agent spouted from the second coloring nozzle 31*b* is larger than that spouted from the third coloring nozzle 31*c*.

Therefore, the spot 7 (shown with an alternate long and short dash line in FIGS. 6A and 6B) formed by spouting from the first coloring nozzle 31*a* is larger than the spot 7 (shown with a solid line in FIGS. 6A and 6B) formed by spouting from the second coloring nozzle 31*b*. The spot 7 formed by spouting from the second coloring nozzle 31*b* is larger than the spot 7 (shown with an alternate long and two short dashes line in FIGS. 6A and 6B) formed by spouting from the third coloring nozzle 31*c*.

Each coloring agent supply source 32, which receives the coloring agent therein, is provided for the corresponding coloring nozzle 31*a*, 31*b* or 31*c*. Each coloring agent supply source 32 supplies the coloring agent into the inlet pipe of the corresponding coloring nozzle 31*a*, 31*b* or 31*c*. The colors B of the coloring agents to be supplied to the coloring nozzles 31*a*, 31*b* and 31*c* from the respective coloring agent supply sources 32 may be different from one another, or alternatively, may be the same one another.

Each pressurized gas supply sources 33 supplies pressurized gas into the corresponding coloring agent supply source 32, thereby when each valve element 44 of the corresponding coloring nozzle 31*a*, 31*b* or 31*c* leaves the corresponding base end 37*a* of the first nozzle member 37, the coloring agent in the channel 39 is promptly spouted from the first nozzle member 37 and the second nozzle member 50.

In the coloring unit 13, when the current is applied to the coil 40 of the desired coloring nozzle 31*a*, 31*b*, 31*c* on the basis of the command from the control device 15, the valve element 44 leaves the base end 37*a* of the first nozzle member 37. Then, the coloring unit 13 spouts the coloring agent in the channel of the desired coloring nozzle 31*a*, 31*b*, 31*c* toward the outer surface 3*a* of the wire 3 with a specific amount of the coloring agent per spouting.

The coloring agent means a liquid substance, in which a coloring material (organic substance for use in industry) is dissolved and dispersed in water or other solvent. The organic substance described above is a dye or a pigment (most of them being organic substances and synthetic substances). Sometimes, a dye is used as a pigment and a pigment is used as a dye. As an example, the coloring agent is a coloring liquid or coating material.

The coloring liquid is a liquid, in which a dye is dissolved or dispersed in a solvent. The coating material is a material, in which a pigment is dispersed in a liquid dispersion. When the coloring liquid adheres to the outer surface 3*a* of the wire 3, the dye permeates into the coating 5. When the coating material adheres to the outer surface 3*a* of the wire 3, the pigment adheres to the outer surface 3*a* without permeating into the coating 5. That is, the coloring unit 13 dyes a part of the outer surface 3*a* of the wire 3 with a dye or coats a part of the outer surface 3*a* of the wire 3 with a pigment. That is, "to color the outer surface 3*a* of the wire 3" means to dye a part of the outer surface 3*a* of the wire 3 with a dye or to coat a part of the outer surface 3*a* of the wire 3 with a pigment.

Preferably, the solvent and liquid dispersion have an affinity to the synthetic resin that constitutes the coating 5 in order to securely permeate the dye into the coating 5 or to allow the pigment to securely adhere to the outer surface 3*a*.

The "spouting" described above means that the liquid coloring agent in a state of the liquid drop is ejected vigorously from the coloring nozzle 31*a*, 31*b*, 31*c* toward the outer surface 3*a* of the wire 3.

As shown in FIG. 1, the encoder 14 includes a pair of rotors 17. The rotor 17 is supported rotatably around the axis of the wire 3. The outer circumferential surface of the rotor 17 comes in contact with the outer surface 3*a* of the wire 3, which is forwarded along the arrow K. When the core wire 4, i.e. the wire 3 is forwarded along the arrow K, the rotor 17 is rotated. The amount of the transfer of the wire 3 along the arrow K is proportional to the number of revolutions of the rotor 17.

The encoder 14 is linked to the control device 15. When the rotor 17 rotates by a specific angle, the encoder 14 outputs a pulse signal to the control device 15. That is, the encoder 14 measures an information corresponding to the amount of the transfer of the wire 3 along the arrow K and outputs the information to the control device 15. Normally, the encoder 14 outputs a pulse signal corresponding to the amount of the transfer of the wire 3 with the aid of the friction between the wire 3 and the rotor 17. However, in the event that the amount of the transfer of the wire 3 does not coincide with the number of the pulse due to a condition of the outer surface 3*a* of the wire 3, the speed information of the transfer of the wire 3 may be obtained from another position so that thus obtained speed information is subjected to feedback so as to make the output to be outputted to the control device 15.

The control device 15 is a computer that includes a known RAM, ROM, CPU and so on. The control device 15, being linked to the motor 16 of the winding reel 11, encoder 14, coloring nozzles 31*a*, 31*b*, 31*c*, and the pressurized gas supply source 33, controls actions of these so as to control the whole of the coloring apparatus 1. Further the control device 15 is linked to an input device (not shown in the figure) as input means including a known keyboard and so on. The input device performs an input of a coloring nozzle 31 selected from the coloring nozzles 31*a*, 31*b* and 31*c*, which coloring nozzle 31 actually spouts the coloring agent.

The control device 15 stores a pattern of the mark 6 in advance. When the control device 15 receives a specific pulse signal from the encoder 14, the control device 15 applies a current to the coil 40 of the selected coloring nozzle 31 as described above for a specific period of time so that the coloring agent is spouted from the coloring nozzle 31 toward the wire 3 with a specific amount of the coloring agent per spouting. According to the pattern of the mark 6, the control device 15 shortens a time interval of the spouting of the coloring agent from the coloring nozzle 31 when the transfer speed of the wire 3 increases, while the control device 15 elongates a time interval of the spouting of the coloring agent from the coloring nozzle 31 when the transfer speed of the wire 3 decreases.

Thus, the control device 15 performs the coloring of the wire 3 according to the pattern stored in advance. The control device 15 makes the coloring nozzle 31 spout the coloring agent with a specific amount thereof per spouting on the basis of the amount of the transfer of the wire 3 measured by the encoder 14. When the inputted (i.e. selected) coloring nozzle 31 is changed by the input device, the control device 15 changes the coloring nozzle 31 that spouts the coloring agent. The time points when the control device 15 makes each valve element 44 be positioned at the opening position for the respective coloring nozzles 31*a*, 31*b* and 31*c* are the same. Further, the values of the pressure for pressurizing the coloring agent in the respective coloring agent supply sources 32 by the respective pressurized gas supply sources are the same.

When the coloring apparatus 1 forms the mark 6 on the outer surface 3*a* of the wire 3, first an end of the wire 3 wound by the feed reel 10 is wound on the winding reel 11. The input device inputs the coloring nozzle 31 that spouts the coloring agent to the control device 15.

Then, the motor 16 is driven so as to rotate the winding reel 11 along the arrow Y1 and to rotate the feed reel 10 along the arrow Y2, thereby the wire 3 is transferred from the feed reel 10 to the winding reel 11. Then, since the brake 12 has given the friction force to the feed reel 10, the wire 3 is stretched in a state that the wire 3 is provided with the tension.

When, the encoder 14 outputs a pulse signal of a specific sequence to the control device 15, the control device 15 applies a current to the coil 40 of the coloring nozzle 31 inputted by the input device for a specific period of time with a specific time interval. Then, the coloring nozzle 31 spouts the coloring agent toward the outer surface 3*a* of the wire 3 with a specific amount of the coloring agent per spouting.

Then, the solvent or the liquid dispersion is evaporated from the coloring agent adhered on the outer surface 3*a* of the wire 3, thereby the outer surface 3*a* of the wire 3 is dyed with the dye or coated with the pigment. Thus, the wire 3 shown in FIG. 6, the outer surface 3*a* of which is provided with the mark 6, is obtained.

Further, upon changing the size of the spot 7, the coloring apparatus 1 changes the coloring nozzle 31*a*, 31*b*, 31*c* that is inputted from the input device to the control device 15 according to the need. Thus, according to the amount of the liquid drop of the coloring agent necessary for forming the spot 7, the coloring apparatus 1 changes the coloring nozzle 31*a*, 31*b*, 31*c* so as to color the outer surface 3*a* of the wire 3.

According to the first preferred embodiment as described above, the amount of the drop of the coloring agent spouted from the long nozzle member 47 is smaller than that spouted from the short nozzle member 47. Thus, depending on the pressure loss occurred when the coloring agent flows in the nozzle member 47, the amount of the drop of the coloring agent increases or decreases. Therefore, a desired coloring nozzle 31 is selected from the coloring nozzles 31*a*, 31*b* and 31*c* having the respective nozzle members 47 of different length L1, L2 and L3, respectively and the selected coloring nozzle 31 is used for spouting, thereby the amount of the drop of the coloring agent can be increased or decreased.

Therefore, by selecting the coloring nozzles 31*a*, 31*b* and 31*c*, the area to be colored (i.e. the area of the spot 7) can be changed. That is, the area to be colored can be easily changed by a simple method, in which a desired coloring nozzle 31 is selected from the coloring nozzles 31*a*, 31*b* and 31*c* having the respective nozzle members 47 of different length L1, L2 and L3, respectively and the selected coloring nozzle 31 is used for spouting.

The wire 3 is stretched in the longitudinal direction Q thereof and the coloring nozzles 31*a*, 31*b* and 31*c* are arranged along the longitudinal direction Q of the wire 3, thereby the coloring agent spouted from all of the coloring nozzles 31*a*, 31*b* and 31*c* can securely adhere to the outer surface 3*a* of the wire 3. By selecting the coloring nozzles 31*a*, 31*b* and 31*c* for spouting the coloring agent, the area to be colored (i.e. the area of the spot 7) can be securely changed.

In the first preferred embodiment as described above, the nozzle member 47 is divided into the first nozzle member 37 and the second nozzle member 50. However, instead, the first nozzle member 37 and the second nozzle member 50 may be formed in one piece to form the nozzle member 47. Further, for example, when a thick wire 3 is to be colored, preferably the coloring agent is spouted from the short nozzle member 47, while when a thin wire 3 is to be colored, preferably the coloring agent is spouted from the long nozzle member 47.

In the following, an apparatus 1 for coloring an electric wire (i.e. coloring apparatus 1) according to a second preferred embodiment of the present invention will be explained with reference to FIGS. 7–11.

Figure 7:
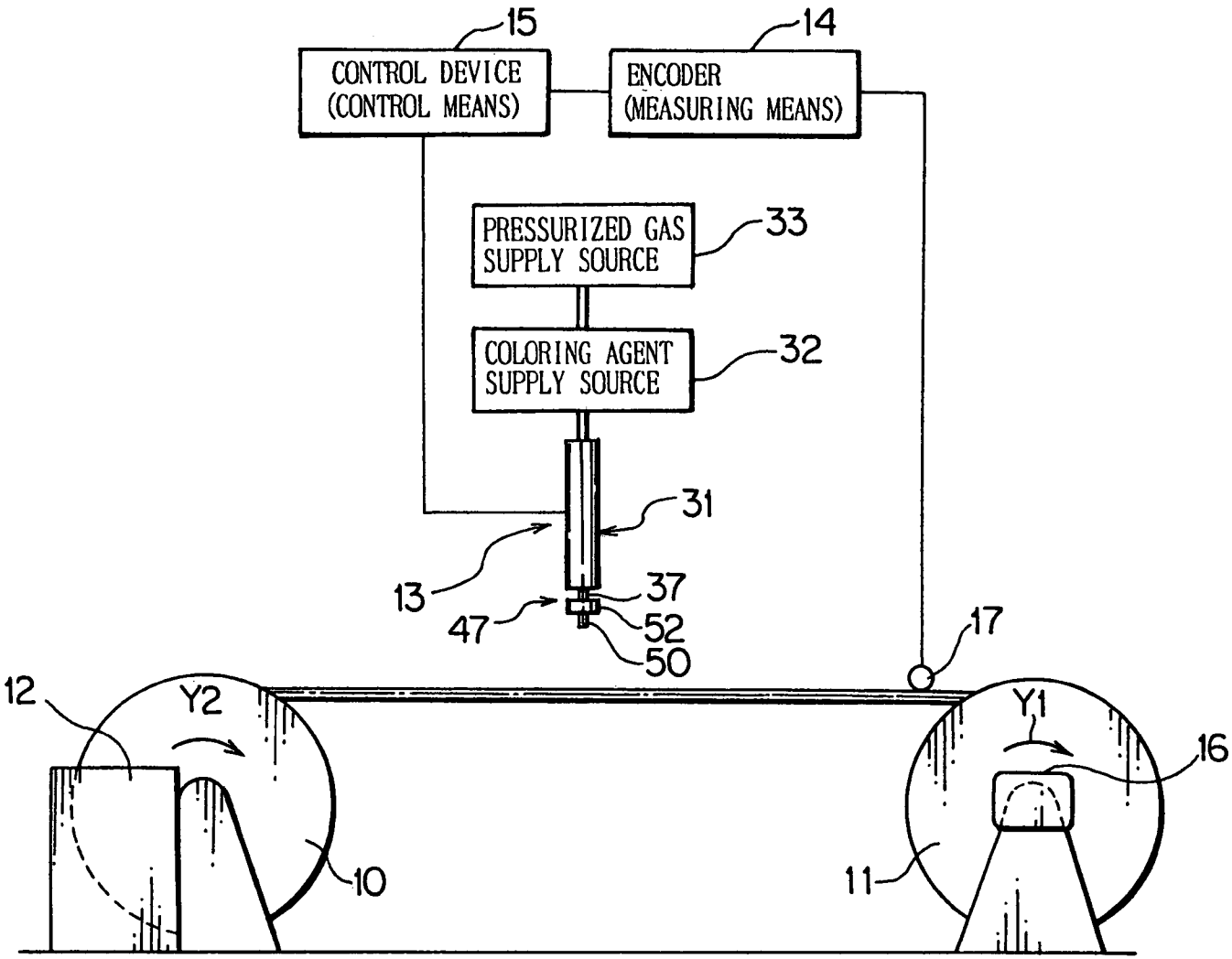
FIG. 7 is an illustration of a structure of an apparatus for coloring a wire according to the second preferred embodiment of the present invention.
Figure 8:
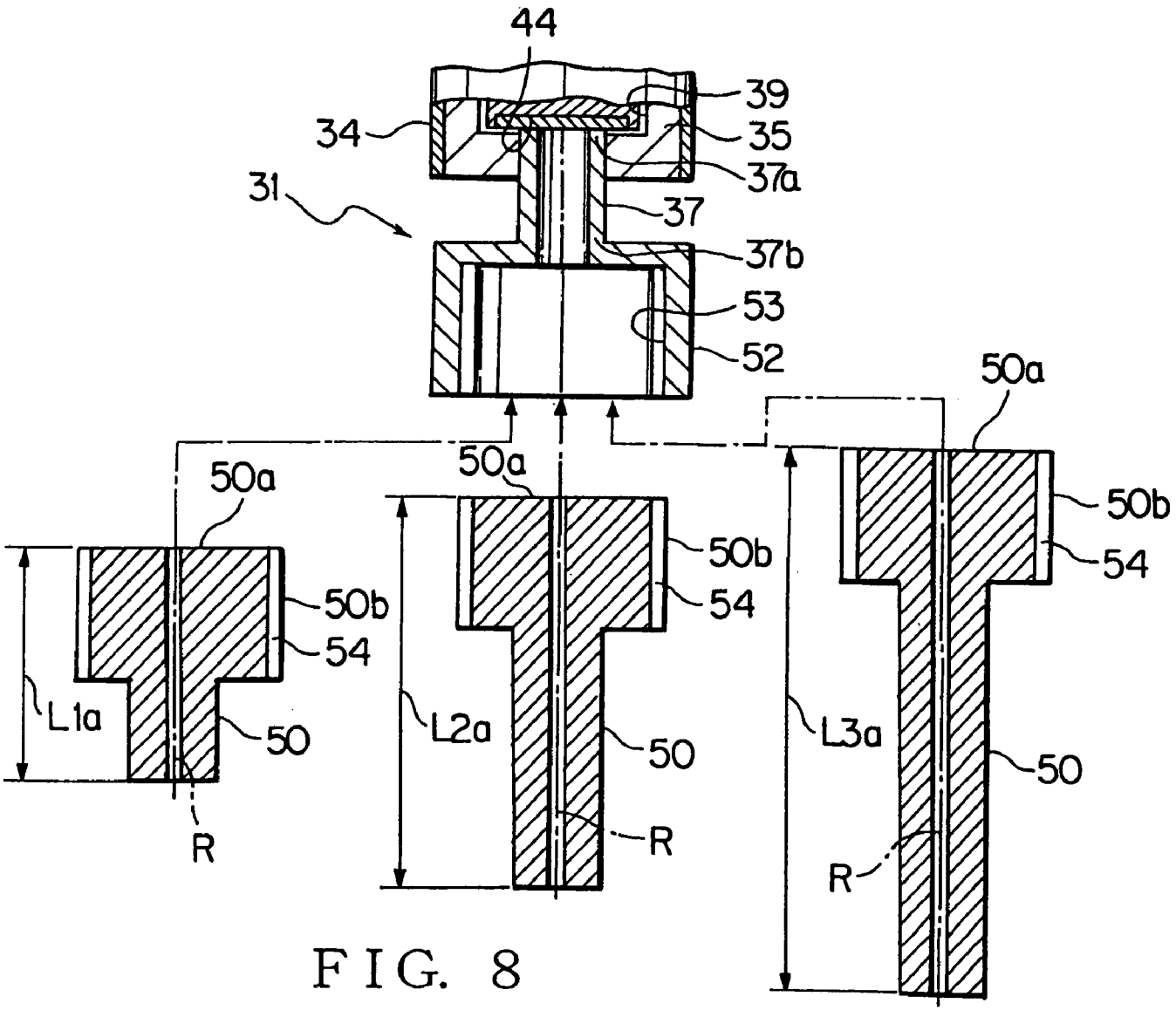
FIG. 8 is a cross sectional view illustrating a structure of a coloring nozzle of a coloring unit in the coloring apparatus shown in FIG. 7.

In an example shown in FIG. 7, the coloring apparatus 1 includes only one coloring nozzle 31. As shown in FIG. 8, to an end 37*b* of the nozzle member 37, each second nozzle member 50 having different length is detachably attached. In FIG. 8, as an example, three second nozzle members 50 are provided.

The end 37*b* of the nozzle member 37 is provided with an inner screw part 52, which is formed in a ring-shape and is aligned with the first nozzle member 37 and a nozzle body 34. The inner screw part 52 has a diameter larger than that of the first nozzle member 37. The inner circumference of the inner screw part 52 is provided with a screw groove 53.

As shown in FIGS. 8–11, the second nozzle member 50 is formed in a cylindrical shape and provided with a screw groove 54 engaging with the screw groove 53 described above on the outer circumference of a base end 50*b* thereof. When the screw groove 54 engages with the screw groove 53, the second nozzle member 50 is attached to the end 37*b* of the first nozzle member 37. When the second nozzle member 50 is attached to the end 37*b* of the first nozzle member 37, the second nozzle member 50 is aligned with the first nozzle member 37. The inner diameter of the second nozzle member 50 is smaller than that of the first nozzle member 37.

Figure 11:
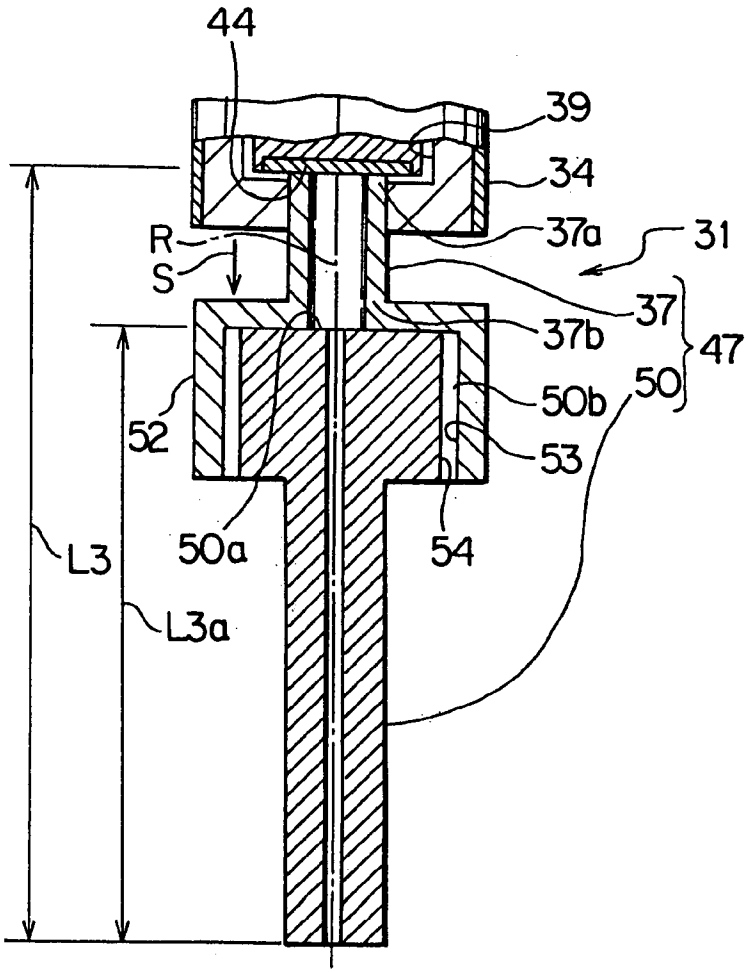
FIG. 11 is a cross sectional view illustrating a state when further second nozzle member is attached to the first nozzle member of the coloring nozzle shown in FIG. 8.
Figure 9:
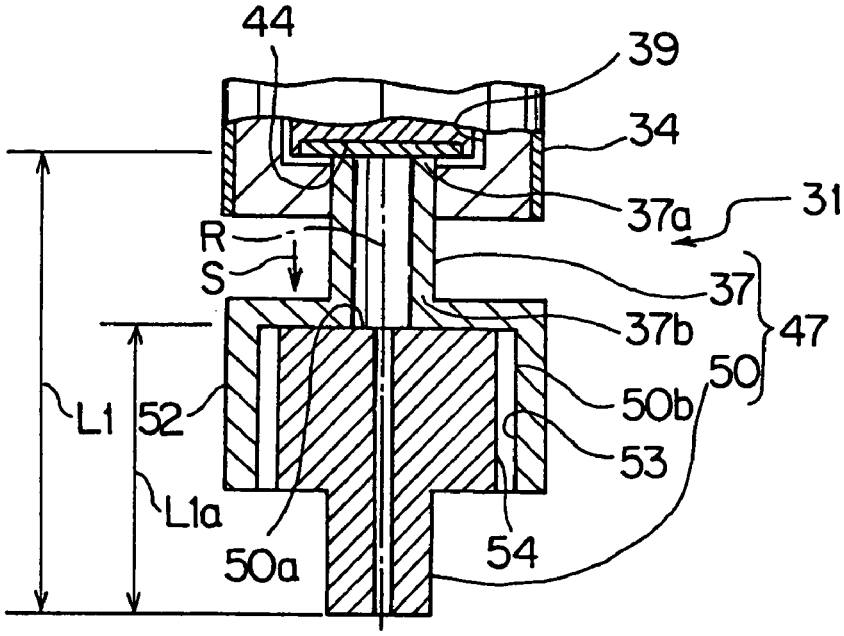
FIG. 9 is a cross sectional view illustrating a state when a second nozzle member is attached to the first nozzle member of the coloring nozzle shown in FIG. 8.
Figure 10:
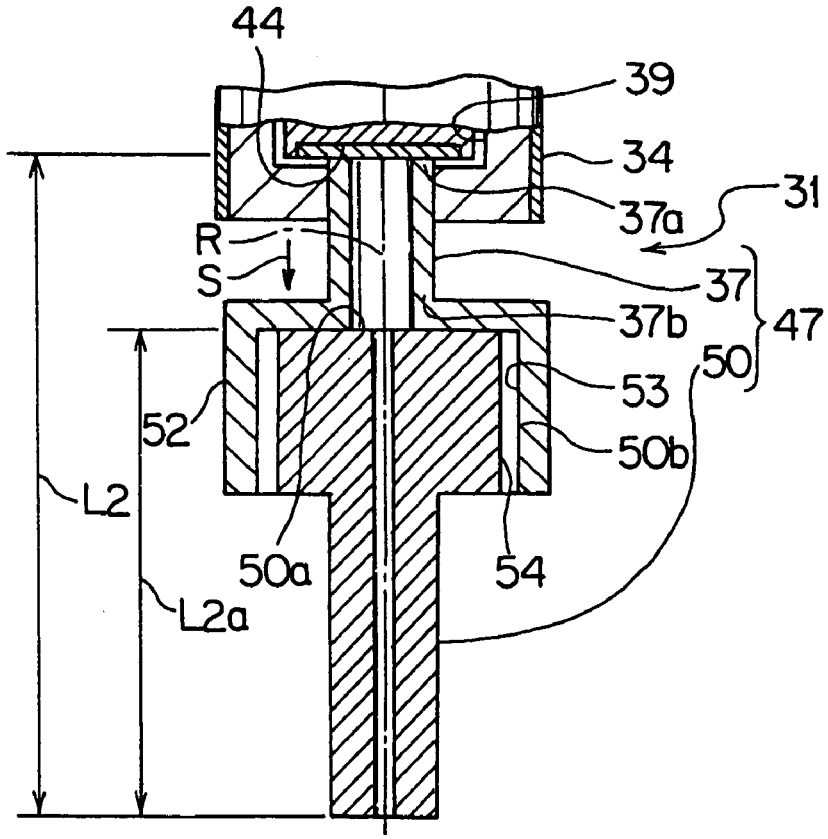
FIG. 10 is a cross sectional view illustrating a state when another second nozzle member is attached to the first nozzle member of the coloring nozzle shown in FIG. 8.

As shown in FIG. 8 and so on, the lengths L1*a*, L2*a* and L3*a* of the respective second nozzle members 50 are different one another. Therefore, when the second nozzle member 50 is attached to the end 37*b* of the first nozzle member 37, the lengths L1, L2 and L3 of the respective nozzle members 47 are different from one another, as shown in FIGS. 9–11.

When the coloring apparatus 1 forms the mark 6 on the outer surface 3*a* of the wire 3, first an end of the wire 3 wound by the feed reel 10 is wound on the winding reel 11. Further, according to the size of the spot 7 to be formed, one second nozzle member 50 is selected from a plurality of the second nozzle members 50 and attached to the first nozzle member 37.

Then, the motor 16 is driven so as to rotate the winding reel 11 along the arrow Y1 and to rotate the feed reel 10 along the arrow Y2, thereby the wire 3 is transferred from the feed reel 10 to the winding reel 11. Then, since the brake 12 has given the friction force to the feed reel 10, the wire 3 is stretched in a state that the wire 3 is provided with the tension.

When, the encoder 14 outputs a pulse signal of a specific sequence to the control device 15, the control device 15 applies a current to the coil 40 of the coloring nozzle 31 inputted by the input device for a specific period of time with a specific time interval. Then, the coloring nozzle 31 spouts the coloring agent toward the outer surface 3*a* of the wire 3 with a specific amount of the coloring agent per spouting.

Then, the solvent or the liquid dispersion is evaporated from the coloring agent adhered on the outer surface 3*a* of the wire 3, thereby the outer surface 3*a* of the wire 3 is dyed with the dye or coated with the pigment. Thus, the wire 3, the outer surface 3*a* of which is provided with the mark 6, is obtained.

Further, upon changing the size of the spot 7, the coloring apparatus 1 changes the second nozzle member 50 to be attached to the first nozzle member 37 according to the need. Thus, according to the amount of the liquid drop of the coloring agent necessary for forming the spot 7, the coloring apparatus 1 changes the second nozzle member 50 so as to color the outer surface 3*a* of the wire 3.

According to the second preferred embodiment, the amount of the drop of the coloring agent spouted when the long second nozzle member 50 is attached is smaller than that spouted when the short second nozzle member 50 is attached. Thus, depending on the pressure loss occurred when the coloring agent flows in the second nozzle member 50 and the first nozzle member 37, the amount of the drop of the coloring agent is increased or decreased.

Therefore, by selecting the desired second nozzle member 50 from the respective second nozzle members 50 having different lengths to one another and attaching it to the first nozzle member 37, the amount of the drop of the coloring agent can be increased or decreased. That is, by selecting the desired second nozzle member 50, the area to be colored (i.e. the area of the spot 7) can be changed. That is, the area to be colored can be easily changed by a simple method, in which the desired second nozzle member 50 is selected from a plurality of the second nozzle members 50 having different lengths to one another and attached to the first nozzle member 37.

In the second preferred embodiment, only one coloring nozzle 31 is provided. However, instead, the coloring apparatus 1 may includes a plurality of the coloring nozzles 31. Further, for example, when a thick wire 3 is to be colored, preferably the nozzle member 47 is set short, while when a thin wire 3 is to be colored, preferably the nozzle member 47 is set long.

In the present invention, as the coloring liquid or coating material, various material may be used, such as acrylic coating material, ink (dye or pigment) and UV-ink.

The aforementioned preferred embodiments are described to aid in understanding the present invention and variations may be made by one skilled in the art without departing from the spirit and scope of the present invention.

What is claimed is:

1. An apparatus for coloring an electric wire comprising:

a plurality of coloring nozzles, each of which spouts a liquid coloring agent as a liquid drop toward an outer surface of an electric wire with a specific amount thereof per spouting so as to allow the liquid drop of the coloring agent to adhere to the outer surface of the electric wire, thereby coloring the electric wire, wherein each coloring nozzle includes a nozzle body having a receiver for receiving the coloring agent and a valve therein and a nozzle member that communicates with the receiver and allows the coloring agent to pass therethrough, wherein the nozzle member is divided into first and second nozzle members and lengths of the respective second nozzle members of the plurality of the coloring nozzles are different from one another, and wherein the coloring nozzle is changed in response to an amount of the liquid drop of the coloring agent.

2. The apparatus for coloring an electric wire according to claim 1, wherein the electric wire is stretched in the longitudinal direction of the electric wire and a plurality of the coloring nozzles are arranged in the longitudinal direction of the electric wire.

3. An apparatus for coloring an electric wire comprising:

a coloring nozzle, which spouts a liquid coloring agent as a liquid drop toward an outer surface of an electric wire with a specific amount thereof per spouting so as to allow the liquid drop of the coloring agent to adhere to the outer surface of the electric wire, thereby coloring the electric wire, wherein the coloring nozzle includes a nozzle body having a receiver for receiving the coloring agent and a valve therein and a first nozzle member that communicates with the receiver and allows the coloring agent to pass therethrough, wherein a plurality of second nozzle members, lengths of which are different from one another, are provided, each second nozzle member being detachably attached to an end of the first nozzle member, and wherein the second nozzle member to be attached to the first nozzle member is changed in response to an amount of liquid drop of the coloring agent.

* * * * *